US009061217B2

(12) United States Patent
Strauss

(10) Patent No.: US 9,061,217 B2
(45) Date of Patent: Jun. 23, 2015

(54) PROJECTILE LAUNCHER

(71) Applicant: Mattel, Inc., El Segundo, CA (US)

(72) Inventor: Michael L. Strauss, Signal Hill, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/483,709

(22) Filed: Sep. 11, 2014

(65) Prior Publication Data

US 2015/0079874 A1 Mar. 19, 2015

Related U.S. Application Data

(60) Provisional application No. 61/877,716, filed on Sep. 13, 2013.

(51) Int. Cl.

| | |
|---|---|
| ***A63H 3/00*** | (2006.01) |
| ***A63H 13/10*** | (2006.01) |
| ***F41B 7/08*** | (2006.01) |
| ***A63H 33/18*** | (2006.01) |

(52) U.S. Cl.
CPC *A63H 13/10* (2013.01); *F41B 7/08* (2013.01); *A63H 33/18* (2013.01); *A63H 3/003* (2013.01)

(58) Field of Classification Search
CPC ..... A63B 69/406; A63B 2069/0008; A63B 69/408; A63H 2200/00; A63H 33/009; A63H 13/10; A63H 3/20
See application file for complete search history.

(56) References Cited

U.S. PATENT DOCUMENTS

| | | | | |
|---|---|---|---|---|
| 831,218 | A | 9/1906 | Falvey | |
| 1,172,570 | A | 2/1916 | Toelle | |
| 1,324,386 | A | 12/1919 | De Clyne | |
| 1,565,607 | A | 12/1925 | Waite | |
| 2,151,546 | A * | 3/1939 | Arnold | 446/308 |
| 2,372,388 | A * | 3/1945 | Munroe | 446/11 |
| 2,596,557 | A * | 5/1952 | Huber | 124/7 |
| 3,103,762 | A | 9/1963 | Glass | |
| 3,817,235 | A * | 6/1974 | Blake | 124/6 |
| 4,193,597 | A * | 3/1980 | Ogawa | 273/405 |
| 4,248,202 | A | 2/1981 | Jaworski et al. | |
| 4,409,953 | A * | 10/1983 | Kennedy et al. | 124/7 |
| 4,623,320 | A | 11/1986 | Kakizaki et al. | |
| 4,659,320 | A * | 4/1987 | Rich et al. | 446/435 |
| 5,611,322 | A * | 3/1997 | Matsuzaki et al. | 124/6 |
| 5,782,228 | A * | 7/1998 | Wu | 124/6 |
| 6,171,169 | B1 | 1/2001 | Saunders | |
| 6,884,186 | B2 * | 4/2005 | Fluckiger et al. | 473/446 |
| 7,265,077 | B1 * | 9/2007 | Netsch | 503/201 |
| 8,943,945 | B1 * | 2/2015 | Collins | 89/8 |
| 2003/0143922 | A1 * | 7/2003 | Du | 446/475 |

(Continued)

*Primary Examiner* — Michael Dennis
*Assistant Examiner* — Urszula M Cegielnik
(74) *Attorney, Agent, or Firm* — The Mueller Law Office, P.C.

(57) ABSTRACT

A toy includes a magazine and a movable arm having a launching end. A plurality of disks are configured to be stacked face to face in the magazine, where each disk has a recess in its face and an engagement element near an edge of the disk. The launching end of the arm includes a retractable extension that is insertable into the recess in the disk, such that the arm is capable of receiving the disk. A protrusion on the magazine engages the engagement element in the disk, causing the disk to rotate around the retractable extension as the arm removes the disk from the magazine. A mechanism in the arm causes the retractable extension to protrude when the arm is adjacent to the magazine, and to retract to release the disk when the arm is moved away from the magazine.

19 Claims, 5 Drawing Sheets

(56) References Cited

U.S. PATENT DOCUMENTS

2006/0260594 A1* 11/2006 Andersen ..... 124/16
2007/0023023 A1* 2/2007 Rosella, Jr. ..... 124/16
2013/0269667 A1* 10/2013 Laporte et al. ..... 124/6

* cited by examiner

PROJECTILE LAUNCHER

RELATED APPLICATIONS

This application claims priority to U.S. Provisional Patent Application No. 61/877,716 filed on Sep. 13, 2013, and entitled "Projectile Launching Figure," which is hereby incorporated by reference for all purposes.

BACKGROUND

Toys that launch projectiles are a common source of entertainment, including launchers that pick up an object and then release the object. For example, tabletop bowling games have utilized a toy figure with a hand that lifts a bowling ball using movable jaws, magnets, or spring mechanisms. The ball may be released by mechanisms such as mechanical triggers, electrical circuits, pull cords, or by the movement of the arm such as in a catapulting action. Other examples of launching toys include baseball pitching games, basketball throwing toys, disk launchers, and toy vehicles, which have also included motorized or pneumatic-actuated launching. Some launching toys have also included a mechanism such as a feed tube or magazine for supplying the balls or projectiles.

Yet, there continues to be a need for unique features in toy launchers to increase interest and enhance creative play.

SUMMARY

In some embodiments, a toy includes a main body, an arm having a first end pivotably coupled to the main body, a magazine coupled to the main body, and a plurality of disks. Each disk has a face, where the disks are configured to be stacked face to face in the magazine, and where each disk has a recess in its face and an engagement element near an edge of the disk. A second end of the arm comprises a retractable extension that is configured to be insertable into the recess in the disk, such that the arm is capable of receiving the disk. A protrusion on the magazine engages the engagement element in the disk, causing the disk to rotate around the retractable extension as the arm removes the disk from the magazine. A mechanism in the arm causes the retractable extension to protrude from the arm when the arm is adjacent to the magazine, and the mechanism causes the extension to retract to release the disk when the arm is pivoted away from the magazine.

In certain embodiments, the magazine includes a plate onto which the disks are stacked, where the plate is spring-biased such that the plate advances the disks out of the magazine. The magazine may include a cylindrical housing in which the plate is located and a front opening from which the disks are removed, where the protrusion on the magazine is near the front opening.

In some embodiments the engagement element is configured as a tooth. The plurality of disks may be configured as ninja stars.

In some embodiments the mechanism in the arm includes a lever coupled to the retractable extension and a rod coupled to the lever. The rod rotates the lever when the arm is pivoted away from the magazine, causing the lever to retract the extension.

In certain embodiments the toy includes an actuation element on the main body, the actuation element being configured to pivot the arm when actuated. The actuation element may move the arm from an initial position to a pivoted position, where the second end of the arm is adjacent to the magazine in the initial position and is forward of the main body in the pivoted position. The actuation element may be spring-biased to return the arm from a pivoted position to an initial position. The spring-bias of the actuation element may also be configured to enable the actuation element to be actuated a plurality of times in rapid succession.

In other embodiments, a toy includes a magazine having a front opening and a protrusion near the front opening; a movable arm having a launching end and a mechanism; and a plurality of disks. The launching end of the arm is configured to move adjacent to the front opening of the magazine. Each disk has a face, where the disks are configured to be stacked face to face in the magazine, and where each disk has a recess in its face and an engagement element near an edge of the disk. The launching end of the arm includes a retractable extension that is configured to be insertable into the recess in the disk, such that the arm is capable of receiving the disk. The protrusion on the magazine engages the engagement element in the disk, causing the disk to rotate around the retractable extension as the arm removes the disk from the magazine. A mechanism in the arm causes the retractable extension to protrude from the arm when the arm is adjacent to the magazine, and the mechanism causes the extension to retract to release the disk when the arm is moved away from the magazine.

In certain embodiments, the magazine includes a plate onto which the disks are stacked, wherein the plate is spring-biased such that the plate advances the disks out of the magazine.

In some embodiments the engagement element is configured as a tooth. The plurality of disks may be configured as ninja stars.

In some embodiments the mechanism in the arm includes a lever coupled to the retractable extension, and a rod coupled to the lever, such that the rod rotates the lever when the arm is moved away from the magazine, causing the lever to retract the extension.

In some embodiments the toy may include an actuation element coupled to the arm, the actuation element being configured to move the arm when actuated. The actuation element may move the arm from an initial position to a launched position, where the launching end of the arm is adjacent to the magazine in the initial position and is away from the magazine in the launched position. The actuation element may be spring-biased to return the arm from a launched position to an initial position. The spring-bias of the actuation element may be configured to enable the actuation element to be actuated a plurality of times in rapid succession.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION

This disclosure relates to toys that are able to release a projectile. An arm has an extension that engages a disk stored in a magazine on the toy, and removes the disk from the magazine as the arm moves away from the magazine. As the disk is removed, a lip on the magazine contacts the disk, causing the disk to rotate. The extension on the arm retracts to release the disk, and the resulting spinning action of the disk adds new play value to the user. A plurality of disks is stored in the magazine, so that the user may repeatedly launch disks in rapid succession. Although the drawings herein shall be shown in relation to a toy figure, the concepts are applicable to other types of objects such as animals, robots, or vehicles.

Figure 1:
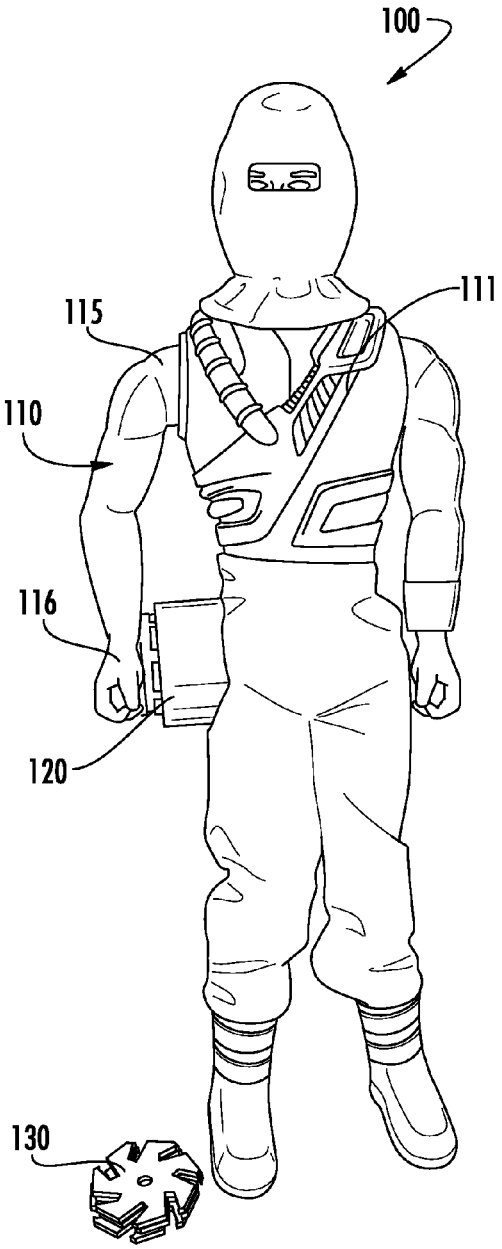
FIG. 1 is a front view of an exemplary toy figure.

FIG. 1 shows a front view of an exemplary toy figure 100 with an arm 110 and a magazine 120. A first end 115 of arm 110 is pivotably coupled to the main body 111 of the toy figure 100, and pivots forward relative to main body 111. In other embodiments, the arm 110 may be movable in other ways, such as a translating motion. Magazine 120, which may also be referred to as a cartridge, is mounted on the figure's side at a location that is accessible by a second end or launching end 116 of arm 110, which is configured as a hand in FIG. 1. In this embodiment, the magazine 120 is located at the hip of figure 100, to match the position of the end 116 of arm 110. In other embodiments, the arm 110 may be coupled to a different part of the toy 100 rather than being mounted to the same component as the magazine 120. For example, the arm 110 may be movably coupled to a wall of a spaceship and the magazine 120 may be mounted on a console of the spaceship, where the arm 110 is configured to move adjacent to the magazine 120 to launch a projectile. Multiple disks 130, shown on the ground here for clarity, may be loaded in the magazine 120 so that the toy figure 100 can launch successive disks one after another. The disks 130 are loaded in a stacked pile, face to face as shown in FIG. 1.

Figure 2:
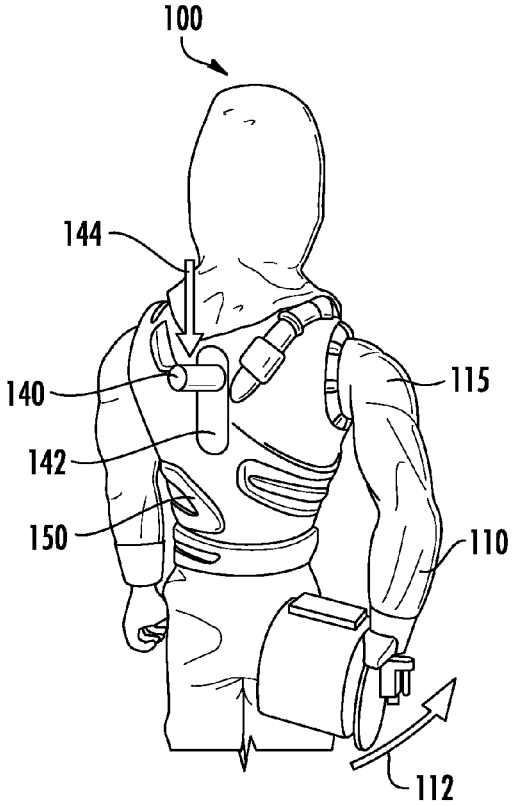
FIG. 2 is a back view of the toy figure of FIG. 1.

FIG. 2 provides a back view of the toy figure 100, showing an actuation element 140 that extends from the back 150 of toy figure 100. The hand at launching end 116 of arm 110 has been removed in FIG. 2 to show inner mechanisms, which shall be described in more detail subsequently. Actuation element 140 is configured as a rod or lever that slides downward along a slot 142 in this embodiment, but may also be configured as a push button, a knob, a wheel, or other shape. When a user presses the actuation lever 140 downward as indicated by arrow 144, the movement of the actuation lever 140 causes arm 110 to rotate forward with respect to the body, pivoting about the shoulder at first end 115, as indicated by arrow 112. Lever 140 may be spring-biased to return arm 110 to its initial position next to magazine 120, after the lever 140 is released. In such an embodiment, a user may repeatedly depress lever 140 to enact rapid successive movements of arm 110. In other embodiments, the actuation element 140 may be configured for rapid firing by holding the actuation element 140 in an actuated position. For example, in one embodiment the actuation element 140 may be a push button that is held down, causing a motor to enact continuous repeated movement of the arm 110.

In other embodiments when the arm 110 has a movement other than pivoting, the actuation element 140 moves the arm 110 from an initial position to a launched position. For example, in one embodiment the launching end 116 of the arm 110 is adjacent to the magazine 120 in the initial position and is away from the magazine 120 in the launched position. The actuation element 140 may be spring-biased to return the arm 110 from the launched position to the initial position. Furthermore, the spring-bias of the actuation element 140 may be configured to enable the actuation element 140 to be actuated a plurality of times in rapid succession.

In yet other embodiments where the arm 110 is coupled to a separate part of the toy 100 than the magazine 120—such as, instead of both the arm 110 and the magazine 120 both being mounted to the main body 111—the actuation element 140 may be coupled to the arm 110 and configured to move the arm 110 when actuated. For example, for an arm 110 that is movably coupled to a wall of a spaceship and the magazine 120 mounted on a console of the spaceship, the actuation element 140 may be a push button that is mechanically or electrically coupled to the arm 110 to initiate movement of the arm 110.

Figure 3:
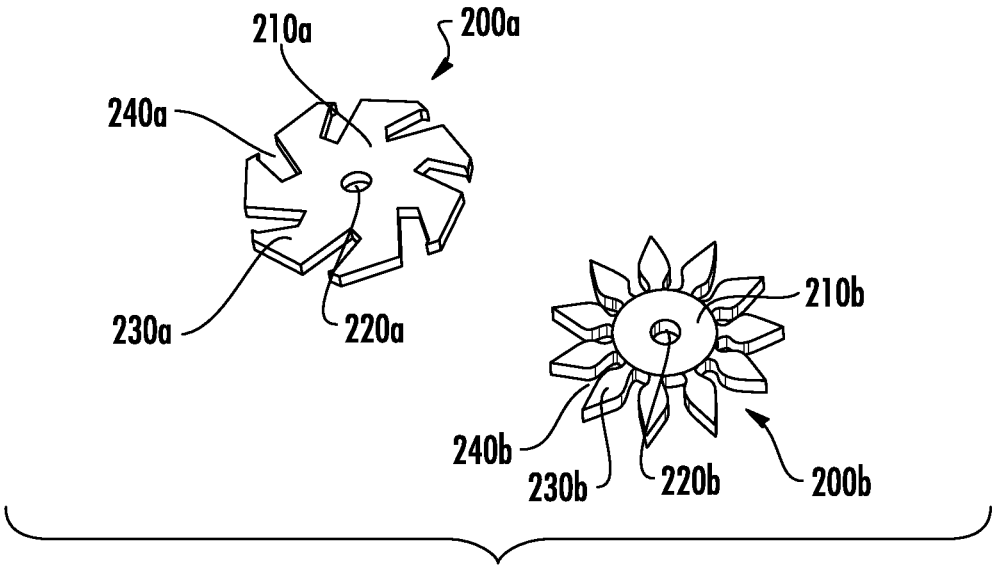
FIG. 3 is a perspective view of exemplary projectiles.

FIG. 3 is a view of exemplary disks 200*a* and 200*b*, which shall be described with correspondingly numbered parts in this figure. Each disk 200*a/b* has a face 210*a/b* that is the circular face of the disk. A central hole 220*a/b* is located near the center of face 210*a/b*. The holes 220*a/b* are shown as through-holes in this embodiment; however, in other embodiments the holes 220*a/b* may be a recess that extends only partially into the thickness of disk 200*a/b*. In such embodiments, a recess may be configured on both faces 210*a/b* of the disk 200*a/b*, so that the disks 200*a/b* are symmetrical for loading into the magazine of the toy figure. The disks 200*a/b* have teeth 230*a/b* around their periphery, with spaces 240*a/b* between teeth 230*a/b*. In FIG. 3, teeth 230*a* are shaped approximately as right triangles and teeth 230*b* are approximately diamond-shaped. Other shapes for teeth 230*a/b* are possible without departing from the scope of this disclosure. The number of teeth 230*a/b* around the edge of the disk 200*a/b* may also vary, such as from one to two or more, such as seven teeth in disk 200*a*, or such as eleven teeth in disk 200*b*. Teeth 230*a/b* provide aesthetic value for the disks, such as to simulate "ninja stars" or other projectiles used in action play. Teeth 230*a/b* also serve as engagement elements with the magazine 120 of FIGS. 1-2 to enable rotation of the disk 200*a/b* as it is being launched, as shall be described in more detail below.

Figure 4:
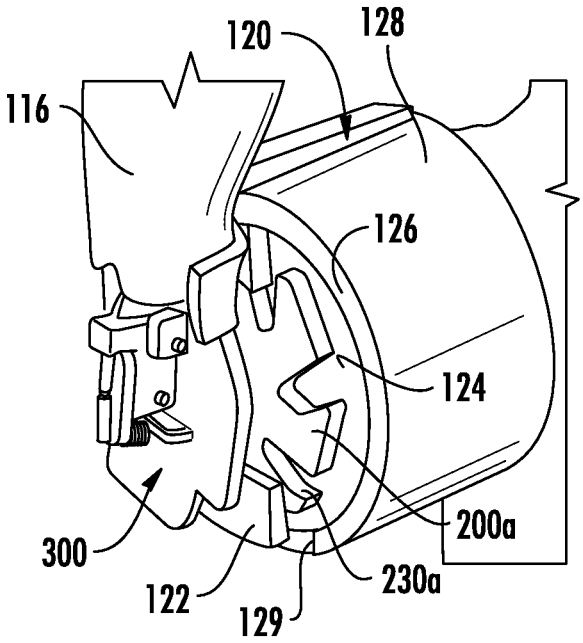
FIG. 4 is a close-up view of a magazine and retrieval assembly in one embodiment.

FIG. 4 shows a close-up perspective view of the magazine 120 with a retrieval assembly 300 at the launching end 116 of the toy 100, where the toy figure's hand is not shown for clarity of the working components. Disk 200*a* is loaded into magazine 120, by placing it in a pocket formed by a rail 122 and plate 124. Rail 122 is embodied here as an annular band spaced apart from the front edge 126 that forms a front opening of magazine 120, where the rail 122 is configured to receive a portion of the periphery of disk 200*a*. Multiple disks 200*a* (or 200*b*) may be stacked face-to-face into the front opening of the housing 128 of magazine 120, by pushing the plate 124 into the housing 128. Housing 128 in this embodiment is cylindrically shaped, to receive circular disks 200*a/b*. Plate 124 is spring-biased such that the plate 124 urges the disks 200*a* toward the front edge 126 of magazine 120, thus advancing the supply of disks 200*a* toward rail 122 and out of magazine 120 as the disks 200*a* are launched.

Figure 5:
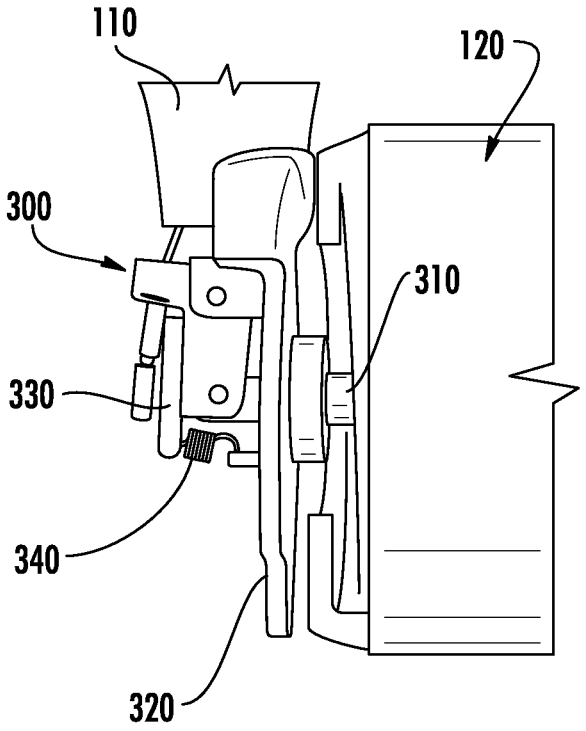
FIG. 5 is a front view of a retrieval assembly in an initial position for removing a disk, in one embodiment.
Figure 6:
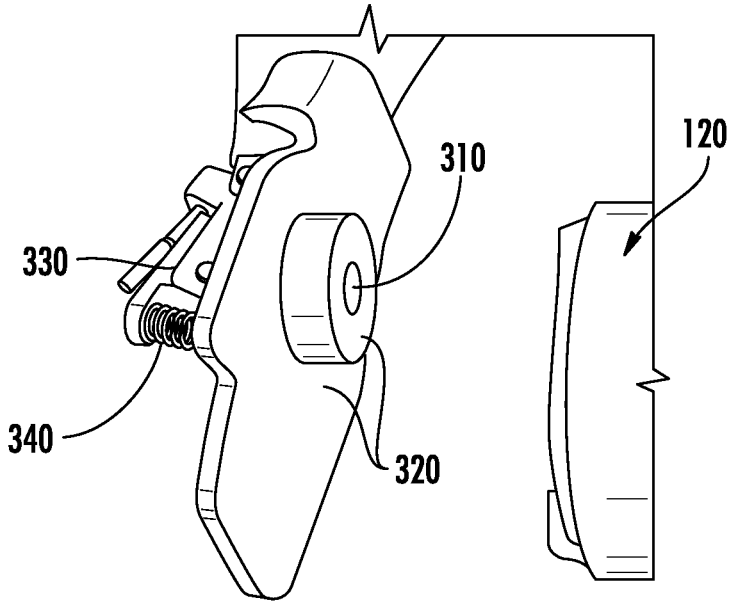
FIG. 6 is a perspective view of the retrieval assembly in a launching position.

FIG. 5 provides a front view of a mechanism of arm 110 for retrieving a disk for launching, in one embodiment. Note that in this figure no disk is loaded in the magazine 120, for clarity of the components of retrieval assembly 300. Retrieval assembly 300 includes a retractable post or extension 310 that extends from a support plate 320 coupled to arm 110, extending toward the magazine 120. Extension 310 is designed to fit into the central recess or hole 220*a/b* of disks 200*a/b* (FIGS. 4A-4B). That is, extension 310 is configured to be insertable into the recess 220*a/b* of the disk 200*a/b*. Thus, when the arm 110 of the toy figure is in its initial position adjacent to the front opening of magazine 120, the extension 310 is inserted into the recess 220*a/b* of the disk 200*a/b* such that the arm 110 receives disk 200*a/b*. Extension 310 is coupled to a lever 330 and spring 340 in retrieval assembly 300, making extension 310 retractable into support plate 320. When a user depresses the actuation lever 140 as in FIG. 2, the arm 110 moves away from the magazine 120 (forward relative to the toy figure 100 in this embodiment), which causes the extension 310 to retract via lever 330 as shown in FIG. 6. Retraction of the extension 310 into the support plate 320 disengages the disk, allowing it to be launched. The actuation lever 140 may be repeatedly depressed and released, with the arm retrieving and releasing a disk 200*a/b* with each actuation. For instance, a user may actuate the lever at a rate of 1-3 times per second to simulate a rapid fire mode. In some embodiments, the toy launching figure 100 may be provided with targets at which the projectiles may be aimed. For example, the user may launch successive projectiles at the target until the target has collapsed or fallen. The target may be, for instance, another toy figure, a building, or an object representing an item needing to be captured or destroyed by the toy figure.

Returning to FIG. 4, magazine 120 also includes a protrusion or lip 129 near the front opening of magazine 120, that engages a tooth 230*a* of disk 200*a*. That is, lip 129 is an edge that protrudes into the path of disk 200*a* as disk 200*a* is moved out of magazine 120. In other embodiments, lip 129 may be incorporated onto rail 122 of magazine 120. In further embodiments, lip 129 may be configured as a different type of protrusion such as a tab or pin. The front edge of tooth 230*a* contacts lip 129 as it is slid forward and out of magazine 120 by retrieval assembly 300. Because the disk 200*a* is being held by post 310 as it is being removed from magazine 120, the engagement of tooth 230*a* with lip 129 causes disk 200*a* to spin around post 310. That is, the protrusion or lip 129 on the magazine 120 engages the engagement element 230*a* in the disk 200*a*, causing the disk 200*a* to rotate around the retractable extension 310 as the arm 110 removes the disk 200*a* from the magazine 120. Thus, disk 200*a* is launched with a rotating motion imparted on it. This spinning action creates new entertainment value for the user, compared to releasing a disk with translational motion only. The spinning motion may also enhance the distance that the disk 200*a* is able to be traversed.

Figure 7:
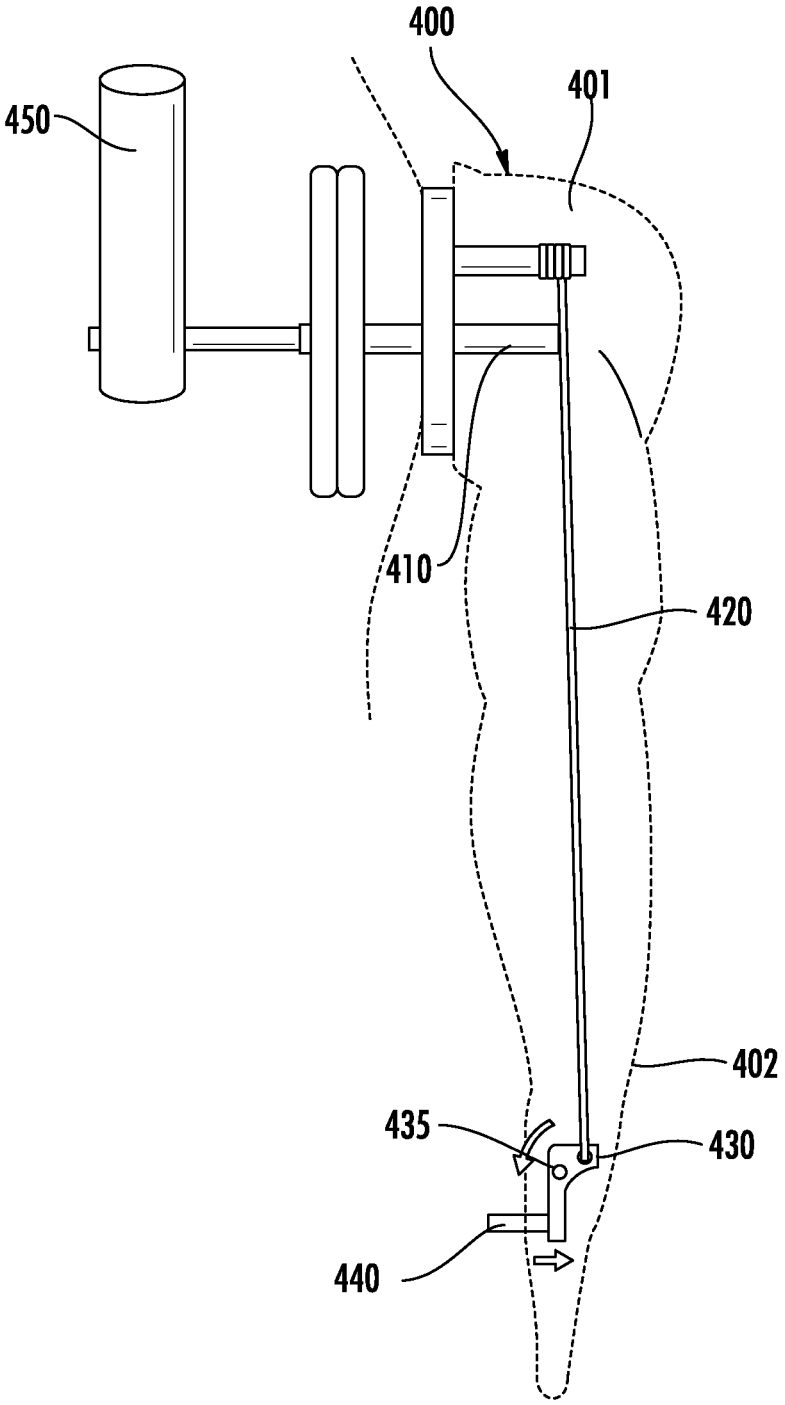
FIG. 7 is a front view of and exemplary arm mechanism.

FIG. 7 shows exemplary internal mechanisms coupling the arm motion to the disk retrieval assembly. In this embodiment, arm 400 pivots about an axle 410 at a first end 401 of arm 400. A rod 420 along the length of arm 400 couples axle 410 to a lever 430 at a second end 402 of arm 400. Lever 430 is L-shaped in this embodiment, and serves as a linkage between rod 420 and an extension 440. Extension 440 is analogous to extension 310 of FIG. 5. When actuation lever 450 is actuated, the arm 400 rotates, which causes rod 420 to pull on lever 430. Lever 430 then pivots around pin 435, causing extension 440 to retract and thus release a disk for launching.

Figure 8:
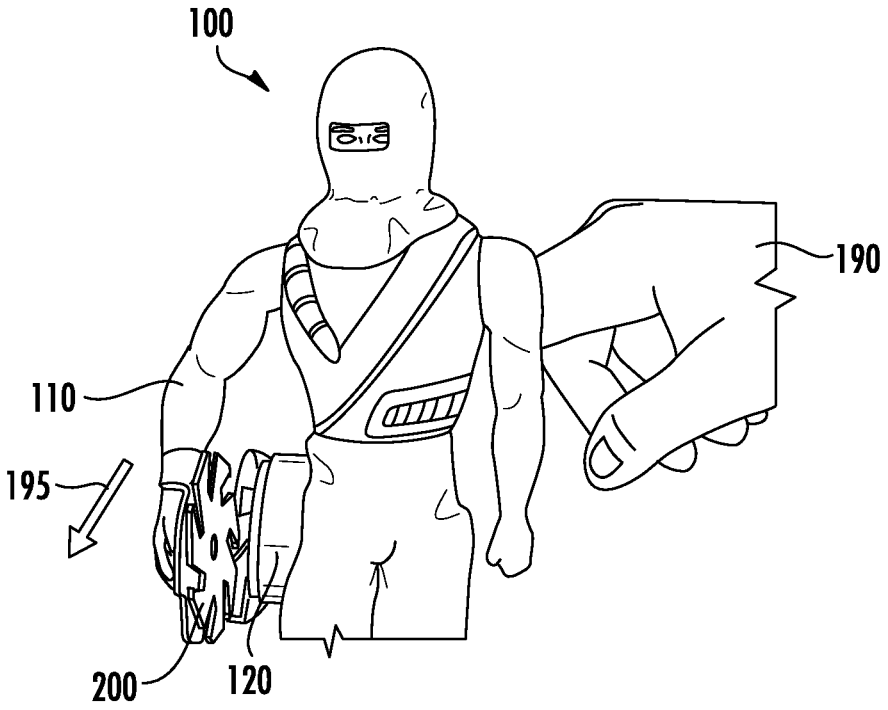
FIG. 8 is a front view of the toy figure of FIG. 1 while launching a projectile.

FIG. 8 shows another exemplary embodiment of the toy figure 100, in use while launching a projectile. A user's hand 190 presses the lever (not shown) on the back of toy figure 100, which moves the arm 110 forward as indicated by arrow 195. As the arm 110 pivots, a disk 200 is removed and launched from magazine 120, with a spinning action. A user may depress the lever repeatedly, in rapid succession, which will cause the toy figure 100 to launch disks 200 one after another. The rapid firing of multiple spinning projectiles provides imaginative and creative play opportunities for the user.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to limit the invention.

What is claimed is:

1. A toy comprising:

a main body;

an arm having a first end pivotably coupled to the main body;

a magazine coupled to the main body;

a plurality of disks, each disk having a face, wherein the disks are configured to be stacked face to face in the magazine, and wherein each disk has a recess in its face and an engagement element near an edge of the disk;

wherein a second end of the arm comprises a retractable extension that is configured to be insertable into the recess in the disk, such that the arm is capable of receiving the disk;

wherein a protrusion on the magazine engages the engagement element in the disk, causing the disk to rotate around the retractable extension as the arm removes the disk from the magazine; and a mechanism in the arm, wherein the mechanism causes the retractable extension to protrude from the arm when the arm is adjacent to the magazine, and wherein the mechanism causes the extension to retract to release the disk when the arm is pivoted away from the magazine.

2. The toy of claim 1, wherein the magazine comprises a plate onto which the disks are stacked, wherein the plate is spring-biased such that the plate advances the disks out of the magazine.

3. The toy of claim 2, wherein the magazine further comprises:

a cylindrical housing in which the plate is located; and a front opening from which the disks are removed;

wherein the protrusion on the magazine is near the front opening.

4. The toy of claim 1, wherein the engagement element is configured as a tooth.

5. The toy of claim 1, wherein the plurality of disks are configured as ninja stars.

6. The toy of claim 1, wherein the mechanism in the arm comprises:

a lever coupled to the retractable extension; and a rod coupled to the lever, such that the rod rotates the lever when the arm is pivoted away from the magazine, causing the lever to retract the extension.

7. The toy of claim 1, further comprising an actuation element on the main body, the actuation element being configured to pivot the arm when actuated.

8. The toy of claim 7, wherein the actuation element moves the arm from an initial position to a pivoted position, wherein the second end of the arm is adjacent to the magazine in the initial position and is forward of the main body in the pivoted position.

9. The toy of claim 7, wherein the actuation element is spring-biased to return the arm from a pivoted position to an initial position.

10. The toy of claim 9, wherein the spring-bias of the actuation element is configured to enable the actuation element to be actuated a plurality of times in rapid succession.

11. A toy comprising:

a magazine having a front opening and a protrusion near the front opening;

a movable arm having a launching end and a mechanism, the launching end being configured to move adjacent to the front opening of the magazine; and a plurality of disks, each disk having a face, wherein the disks are configured to be stacked face to face in the magazine, and wherein each disk has a recess in its face and an engagement element near an edge of the disk;

wherein the launching end of the arm comprises a retractable extension that is configured to be insertable into the recess in the disk, such that the arm is capable of receiving the disk;

wherein the protrusion on the magazine engages the engagement element in the disk, causing the disk to rotate around the retractable extension as the arm removes the disk from the magazine;

wherein the mechanism causes the retractable extension to protrude from the arm when the arm is adjacent to the magazine; and wherein the mechanism causes the extension to retract to release the disk when the arm is moved away from the magazine.

12. The toy of claim 11, wherein the magazine comprises a plate onto which the disks are stacked, wherein the plate is spring-biased such that the plate advances the disks out of the magazine.

13. The toy of claim 11, wherein the engagement element is configured as a tooth.

14. The toy of claim 11, wherein the plurality of disks are configured as ninja stars.

15. The toy of claim 11, wherein the mechanism in the arm comprises:

a lever coupled to the retractable extension; and a rod coupled to the lever, such that the rod rotates the lever when the arm is moved away from the magazine, causing the lever to retract the extension.

16. The toy of claim 11, further comprising an actuation element coupled to the arm, the actuation element being configured to move the arm when actuated.

17. The toy of claim 16, wherein the actuation element moves the arm from an initial position to a launched position, wherein the launching end of the arm is adjacent to the magazine in the initial position and is away from the magazine in the launched position.

18. The toy of claim 16, wherein the actuation element is spring-biased to return the arm from a launched position to an initial position.

19. The toy of claim 18, wherein the spring-bias of the actuation element is configured to enable the actuation element to be actuated a plurality of times in rapid succession.

* * * * *